US006538639B1

(12) United States Patent
Takahashi

(10) Patent No.: US 6,538,639 B1
(45) Date of Patent: Mar. 25, 2003

(54) MULTI-DIRECTION INPUT DEVICE FOR FETCHING A SENSING SIGNAL CORRESPONDING TO AN AMOUNT OF INCLINATION OF LEVER MEMBER

(75) Inventor: Kisaburo Takahashi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 255 days.

(21) Appl. No.: 09/607,848

(22) Filed: Jun. 30, 2000

(30) Foreign Application Priority Data

Jul. 5, 1999 (JP) ..... 11-190055
Jul. 5, 1999 (JP) ..... 11-190056

(51) Int. Cl.[7] ..... G09G 5/08
(52) U.S. Cl. ..... 345/161; 345/172; 200/6 A
(58) Field of Search ..... 345/156, 157, 345/158, 161, 167, 172; 338/128, 130; 200/5 A, 6 A

(56) References Cited

U.S. PATENT DOCUMENTS 3,795,882 A 3/1974 Tokubo
5,828,363 A * 10/1998 Yaniger et al. ..... 345/156
6,150,919 A * 11/2000 Shimomura ..... 338/128
6,285,356 B1 * 9/2001 Armstrong ..... 345/167

FOREIGN PATENT DOCUMENTS

JP 4-36618 3/1992

* cited by examiner

*Primary Examiner*—Steven Saras
*Assistant Examiner*—Amr Awad
(74) *Attorney, Agent, or Firm*—Brinks Hofer Gilson & Lione

(57) ABSTRACT

A multi-direction input device includes first and second association members having holes formed therethrough at the positions thereof where they overlap each other in an intersecting state, a case for turnably suspending the first and second association members, and a lever member inclinably supported by the case and inserted into the holes. First and second actuating sections are formed on the first and second association members, respectively. When the lever member is inclined, the first actuating section is turned together with the first association member and the second actuating section is turned together with the second association member. Further, the case is provided with a first turn detecting unit for detecting the turn of the first actuating section and a second turn detecting unit for detecting the turn of the second actuating section. With this arrangement, the size of the multi-direction input device can be reduced in directions where straight lines connecting the centers of turn of mounting sections extend.

10 Claims, 8 Drawing Sheets

MULTI-DIRECTION INPUT DEVICE FOR FETCHING A SENSING SIGNAL CORRESPONDING TO AN AMOUNT OF INCLINATION OF LEVER MEMBER

BACKGROUND OF THE INVENTION

1. Field of the Invention

The present invention relates to a multi-direction input device capable of fetching a sensing signal which is generated by actuating a lever member inclinably supported by a case and corresponds to an amount of inclination of the lever member.

2. Description of the Related Art

FIGS. 8 to 10 are views explaining a conventional art of this type of a multi-direction input device. In the figures, the multi-direction input device is mainly composed of a box-shaped frame member 51, which has an upper plate section through which a circular insert hole 51*a* is formed and an open lower surface, two rotary type variable resistors 52 mounted on a side plate section of the frame member 51, first and second association members 56 and 59, which overlap each other in an intersecting state and are suspended in the frame member 51, a lever member 62, which passes through the first and second association members 56 and 59 and projects from the insert hole 51*a* of the frame member 51, a return spring 71 for automatically returning the lever member 62 to its original position, a holder member 68 for holding the return spring 71, and a lid plate 72 for covering the open lower surface of the frame member 51.

The frame member 51 is formed by bending a flat metal sheet and has confronting pairs of side wall sections through which a pair of locking holes 51*b* and 51*d* and a pair of locking holes 51*c* and 51*e* are formed, respectively. The rotary type variable resistors 52 are mounted on the outer wall surfaces of the side wall sections having the locking holes 51*c* and 51*d* formed therethrough, respectively. As shown in FIG. 9, a resistance value of each rotary type variable resistor 52 is varied in such a manner that the rotation of a shaft 54 held through the shaft hole 53*a* of a mounting frame 53 causes a not shown slider, which is caulked on a rotary plate 54*a*, to slide on a resistor plate 55.

The first association member 56 includes an arch-shaped base section 57, and mounting sections 58 disposed on both the sides of the base section 57. The base section 57 includes a hole 57*a* formed therethrough so as to extend in the lengthwise direction thereof, and a shaft hole 58*a* is formed through each mounting section 58. Then, the first association member 56 is turnably suspended in the frame member 51 in such a manner that it is supported by the frame member 51 with both the mounting sections 58 locked in the pair of locking holes 51*c* and 51*e*. The shaft 54 of one of the rotary type variable resistors 52 is inserted into the shaft hole 58*a* of the mounting section 58 locked in the locking hole 51*c* under pressure.

The second association member 59 includes a columnar base section 60 whose central portion is swelled, and mounting sections 61 disposed on both the ends of the base section 60. A hole 60*a*, which extends in the lengthwise direction of the base section 60, and an inserting hole 60*b*, which intersects the hole 60*a*, are formed through the swelled portion of the base section 60, respectively, and a shaft hole 61*a* is formed through one of the mounting sections 61. Then, the second association member 59 is turnably suspended in the frame member 51 in a state in which it overlaps the first association member 56 in an intersecting state in such a manner that it is supported by the frame member 51 with both the mounting sections 61 locked in the pair of locking holes 51*b* and 51*d*. The hole 57*a* confronts the hole 60*a* at the portion where the first association member 56 overlaps the second association member 59, and the shaft 54 of the other of the rotary type variable resistors 52 is inserted into the shaft hole 61*a* of the mounting section 61 locked in the locking hole 51*d* under pressure.

The lever member 62 includes a rectangular support section 63, a shaft section 64 projecting from the upper and lower ends of the support section 63, and a disc-shaped spring receiver 65 located at a lower portion of the support section 63 and formed integrally with the shaft section 64, and the support section 63 has a through hole 63*a* formed therethrough. Then, the lever member 62 is inclinably supported by the frame member 51 through the second association member 59 in such a manner that the shaft section 64 is inserted into the holes 57*a* and 60*a* of the first and second association members 56 and 59, and a round pin 66, which has been inserted from the inserting hole 60*b* of the second association member 59, is inserted into the through hole 63*a*. Further, a knob 67 is secured to the upper end of the shaft section 64 projecting from the insert hole 51*a* of the frame member 51.

The holder member 68 includes a cup-shaped spring receiver 69, and a cylindrical boss section 70 which stands on the inner bottom surface of the spring receiver 69. As shown in FIG. 9, the spring receiver 69 is accommodated in the frame member 51 with a return spring 71, which is composed of a conical coil spring, accommodated in the spring receiver 69 and with the lower end of the shaft section 64 of the lever member 62 inserted into the boss section 70. In the above arrangement, the upper end of the return spring 71 abuts the spring receiver 65 of the lever member 62.

The lid plate 72 is formed of a flat metal sheet and has a rectangular shape and its mounting pieces 72*a* are suitably secured to the lower end of the frame member 51 so as to close the lower surface thereof. Then, the spring receiver 69 of the holder member 68 is elastically abutted against the lid plate 72 by the elastic force of the return spring 71. The lever member 62 is held by the elastic abutment at an initial position which is vertical to the lid plate 72 shown in FIG. 9, whereby a clearance t is formed between the upper end of the boss section 70 of the holder member 68 and the spring receiver 65 of the lever member 62.

Next, a method of assembling the multi-direction input device arranged as described above will be described. First, the lever member 62 is inserted into the hole 60*a* of the second association member 59 from the upper end thereof, and the round pin 66 is inserted into the through hole 63*a* from the inserting hole 60*b* so as to assemble the lever member 62 and the second association member 59. Then, the lever member 62 is inserted into the hole 57*a* of the first association member 56 from the upper end side thereof so that first association member 56 overlaps the second association member 59 in an intersecting state, whereby the lever member 62 and the first and second association members 56 and 59 are arranged as a unit. Thereafter, the unit is inserted into the frame member 51 from the open lower surface thereof with the lower ends of the side wall sections of the frame member 51 slightly pushed externally and widened, the upper end of the shaft section 64 is caused to project from the insert hole 51*a*, the side wall sections of the frame member 51 are returned inwardly, and the first and second association members 56 and 59 are suspended by the frame member 51 with the mounting sections 58 and 61 locked in and supported by the locking holes 51*b* to 51*e* while adjusting a bending angle of the side wall sections with respect to an upper plate section.

Next, the knob 67 is secured to the lever member 62, the two rotary type variable resistors 52 are mounted on the side wall sections of the frame member 51, then the return spring 71 is accommodated in the spring receiver 69 of the holder member 68, the shaft section 64 of the lever member 62 is inserted into the boss section 70, and the holder member 68 is accommodated in the frame member 51. Thereafter, the mounting pieces 72*a* are suitably secured to the lower end of the frame member 51, and the lid plate 72 is mounted on the frame member 51.

In the conventional multi-direction input device arranged and assembled as described above, when an operator inclines the knob 67, the lever member 62 is inclined and the first and second association members 56 and 59 are turned while the shaft section 64 of the lever member 62 is loosely moved in the holes 57*a* and 60*a*, whereby the respective shafts 54 of the two rotary type variable resistors 52 are rotated. Simultaneously with the above operation, since the holder member 68 is inclined together with the lever member 62, the lower end of the shaft section 64 is further inserted into the boss section 70 with the return spring 71 compressed by the spring receiver 65 so that the holder member 68 approaches the spring receiver 65 as shown in FIG. 10. As the shafts 54 are rotated, varied resistance values are fetched from the terminals 73 extracted from the resistor plates 55 of the respective rotary type variable resistors 52 as detecting signals corresponding to amounts of inclination of the lever member 62. The detecting signals are supplied to, for example, a display device (not shows) so that a position of a cursor on a display can be controlled.

Further, when a force for inclining the knob 67 is removed, the holder member 68 is returned to the lid plate 72 side by a restoring force of the return spring 71 and raised together with the lever member 62, so that the lever member 62 is returned to its initial position and the state shown in FIG. 9 is restored.

However, the above conventional multi-direction input device has the following drawbacks. That is, since the rotary type variable resistors 52 are mounted on the outside wall surfaces of the side wall sections of the frame member 51, the size of the multi-direction input device is increased by the spaces where the rotary type variable resistors 52 are mounted in a direction, where a straight line 59*a* connecting the centers of turn of both the mounting sections 51 of the second association member 59, extends and in a direction, where a straight line connecting the centers of turn of both the mounting sections 58 of the first association member 56, extends similarly to the above. Accordingly, it is difficult to reduce the size of the multi-direction input device.

Further, since a job is necessary to return the side wall sections of the frame member 51 inwardly, which has been widened externally in order to suspend the first and second association members 56 and 59 by the frame member 51, and to adjust a bending angle of the side wall sections with respect to the upper plate section, a problem arises in that the number of man-hours is increased and a cost is increased thereby.

Furthermore, the movement of the mounting sections 58 and 61 in the locking holes 51*b* to 51*e* is regulated by variations in a bending angle of the side wall sections of the frame member 51 with respect to the upper plate section regulate, and the turning motions of the first and second association members 56 and 59 are obstructed thereby. Accordingly, the assembly process of the multi-direction input device becomes very complex to improve an accuracy of the bending angle.

A first object of the present invention, which was made in view of the circumstances of the above conventional technology, is to provide a multi-direction input device capable of reducing the size thereof in the directions where the straight lines connecting the centers of turn of mounting sections extend.

A second object of the present invention is to provide a multi-direction input device which permits first and second association members to easily be suspended and to smoothly be turned without the need of any adjustment.

SUMMARY OF THE INVENTION

To achieve the above object, one of the most important features of an multi-direction input device of the present invention resides in that it includes first and second association members overlapping each other in an intersecting state and each including a base section, which has a hole formed therethrough at the position thereof where they overlap each other, and mounting sections disposed at both the ends of the base section; a case for supporting the mounting sections of the first and second association members, respectively and for turnably suspending them; and a lever member inclinably supported by the case and inserted into the respective holes of the first and second association members, wherein a first actuating section, which projects in a direction intersecting a straight line connecting the centers of turn of both the mounting sections of the first association member is formed on the base section thereof, a second actuating section, which projects in a direction intersecting a straight line connecting the centers of turn of both the mounting sections of the second association member, is disposed on the base section thereof, the inclination of the lever member causes the first actuating section to turn together with the first association member and the second actuating section to turn together with the second association member, and the case is provided with a first turn detecting unit for detecting the turn of the first actuating section and with a second turn detecting unit for detecting the turn of the second actuating section.

Accordingly, the first and second turn detecting units can be disposed in the direction which intersects the straight line connecting the centers of turn of both the mounting sections of the first association member and in the direction which intersects the straight line connecting the centers of turn of both the mounting sections of the second association member, respectively, whereby the size of the multi-direction input device can be reduced in the direction where the straight line connecting the centers of turn of both the mounting sections of the first association member extends and in the direction where the straight line connecting the centers of turn of both the mounting sections of the second association member extends.

In the above arrangement, each of the first and second turn detecting units includes a movable member disposed on the case so as to reciprocate thereon, fixed side elements fixed on the case, and a movable side element disposed on the movable member and forming a signal creating section together with the fixed side elements, the movable member of the first turn detecting unit and the movable member of the second turn detecting unit are engaged with the first and second actuating sections, respectively and moved as the first and second actuating sections are turned, whereby the signal creating sections of the first and second turn detecting units create detecting signals.

Accordingly, the turns of the first and second actuating sections can be reliably detected in spite of that the above components are arranged simply.

In the above arrangement, the movable side element is composed of a resistor layer formed on the movable member and the fixed side elements is composed of sliders which are in sliding contact with the resistor layer as well as terminals for outputting the detecting signal are formed integrally with the sliders.

Therefore, the resistor layer can easily be formed by print with improved productivity, and the number of components can be reduced by forming the sliders integrally with the terminals.

Further, in the above arrangement, the case includes four standing walls disposed on the four sides thereof, the first and second association members are turnably suspended by the four standing walls with the respective mounting sections thereof locked thereto, and the first and second turn detecting unit are disposed in a region surrounded by the four standing walls.

Accordingly, the first and second association members can easily be supported by the case so that the multi-direction input device can easily be assembled as well as the first and second detecting units can be disposed making use of the space occupied by the first and second actuating sections in the case, whereby the size of the device can be more reduced.

In the above arrangement, round-shaped portions are formed at the extreme ends of the first and second actuating sections, and slots, into which the round-shaped portions are inserted, are formed through the movable members.

Therefore, no backlash arises in the movement of the movable members, whereby the responsiveness of the first and second detecting units can be improved.

To achieve the above second object, another of the most important features of a multi-direction input device of the present invention resides in that it includes a case including a bottom wall section and four standing walls disposed on the four sides thereof; first and second association members overlapping each other in an intersecting state and supported by the case and having holes formed therethrough at the positions thereof where they overlap each other; and a lever member inclinably supported by the case and inserted into the respective holes of the first and second association members, wherein locking holes are formed through the four standing walls, respectively, the first and second association members are inserted from the free end sides of the four standing walls while flexing them externally, and both the ends of the first and second association members are locked in the respective locking holes of the four standing walls, which have elastically returned inwardly and snapped therein, whereby the first and second association members are turnably suspended by the respective confronting pairs of standing walls.

Accordingly, since the adjustment job described in the conventional art is not necessary and the multi-direction input device can simply be assembled, the first and second association members can easily be suspended and the first and second association members can smoothly be turned without the need of any adjustment.

In the above arrangement, taper surfaces are formed on the free end sides of the four standing walls on the inner wall surfaces thereof such that they incline inwardly toward the bottom wall section from the extreme ends of the free end sides, and both the ends of the first and second association members are inserted into and locked in the respective locking holes of the four standing walls by being guided by the taper surfaces.

Thus, both the ends of the first and second association members can simply be locked in the respective locking holes of the four standing walls and snapped therein.

In the above arrangement, the lever member, which has been inserted into the hole of the second association member, is locked and snapped therein so as to be mounted on the second association member.

Accordingly, the lever member can simply be supported by the case through the second association member.

In the above arrangement, a first actuating section, which projects in a direction intersecting a straight line connecting the centers of turn of mounting sections disposed at both the ends of the first association member, is formed on the first association member, a second actuating section, which projects in a direction intersecting a straight line connecting the centers of turn of mounting sections disposed at both the ends of the second association member, is disposed on the second association member, the inclination of the lever member causes the first actuating section to turn together with the first association member and the second actuating section to turn together with the second association member, and the case is provided with a first turn detecting unit for detecting the turn of the first arm and a second turn detecting unit for detecting the turn of the second arm.

Accordingly, the first and second turn detecting units can be disposed in the direction which intersects the straight line connecting the centers of turn of both the mounting sections of the first association member and in the direction which intersects the straight line connecting the centers of turn of both the mounting sections of the second association member, respectively, whereby the size of the multi-direction input device can be reduced in the direction where the straight line connecting the centers of turn of both the mounting sections of the first association member extends and in the direction where the straight line connecting the centers of turn of both the mounting sections of the second association member extends.

Further, in the above arrangement, each of the first and second turn detecting units includes a movable member disposed on the case so as to reciprocate, fixed side elements fixed to the case, and a movable side element disposed on the movable member and forming a signal creating section together with the fixed side elements, the movable member of the first turn detecting unit and the movable member of the second turn detecting unit are engaged with the first and second arm sections and moved as the first and second arm sections are turned, whereby the signal creating sections of the first and second turn detecting units create detecting signals.

Accordingly, the turns of the first and second actuating sections can be reliably detected in spite of that the above components are arranged simply.

DESCRIPTION OF THE PREFERRED EMBODIMENT

Figure 1:
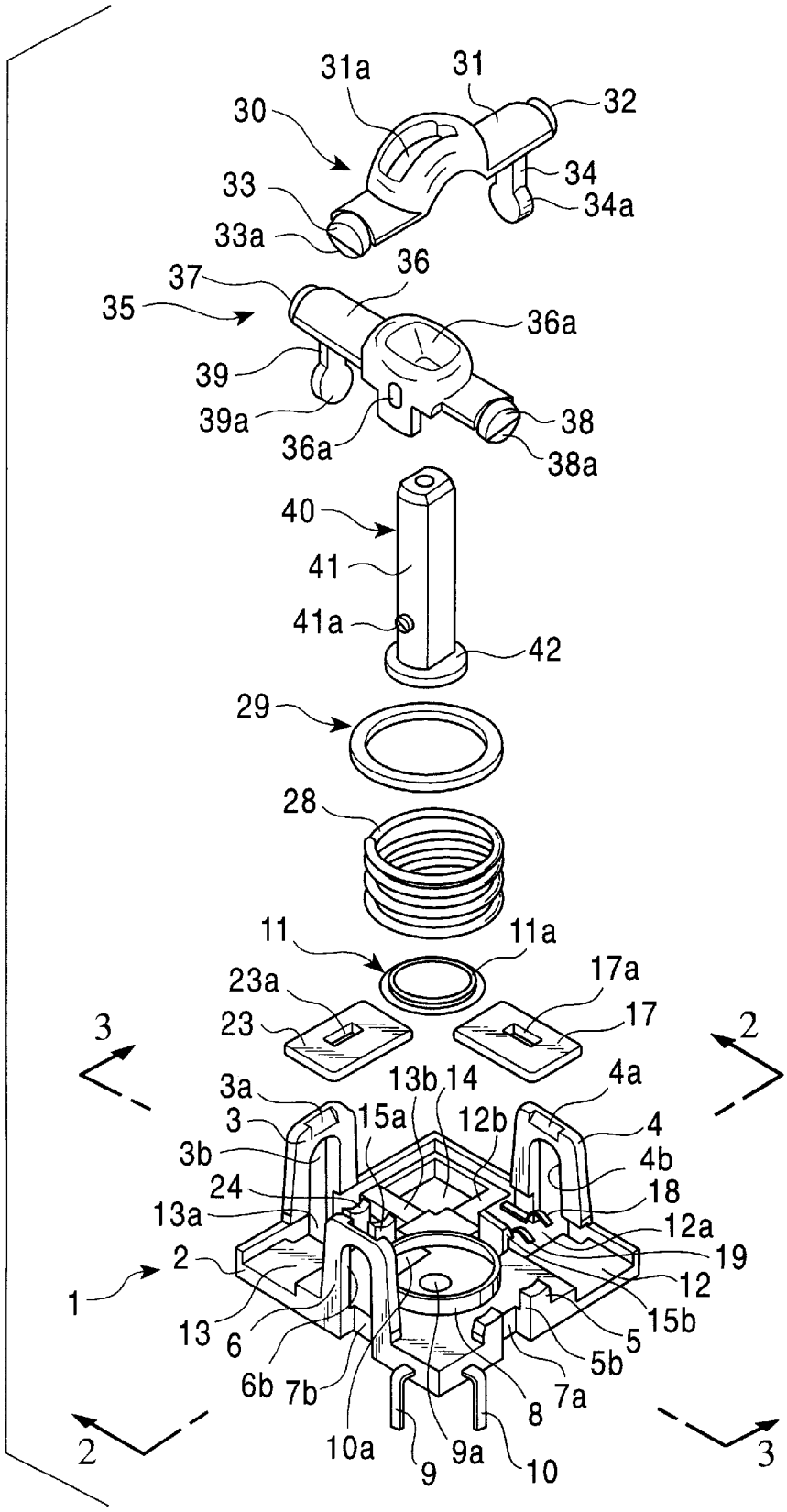
FIG. 1 is an exploded perspective view of a multi-direction input device of an embodiment of the present invention.

An embodiment of a multi-direction input device of the present invention will be described below in connection with FIG. 1 to FIG. 7.

The multi-direction input device is composed of first and second association members 30 and 35 having holes 31*a* and 36*a* formed therethrough at the positions thereof where they overlap each other in an intersecting state, a case 1 for supporting both the ends of each of the first and second association members 30 and 35, respectively, thereby turnably suspending them, a lever member 40 inclinably supported by the case 1 and inserted into the holes 31*a* and 36*a* of the first and second association members 30 and 35, first and second turn detecting units 16 and 22 for creating detecting signals corresponding to an amount of inclination of the lever member 40, a return spring 28 for automatically returning the lever member 40 to an initial position, and the like. As described below, the first and second association members 30 and 35 are turned bi-directionally when the lever member 40 is inclined.

Figure 5:
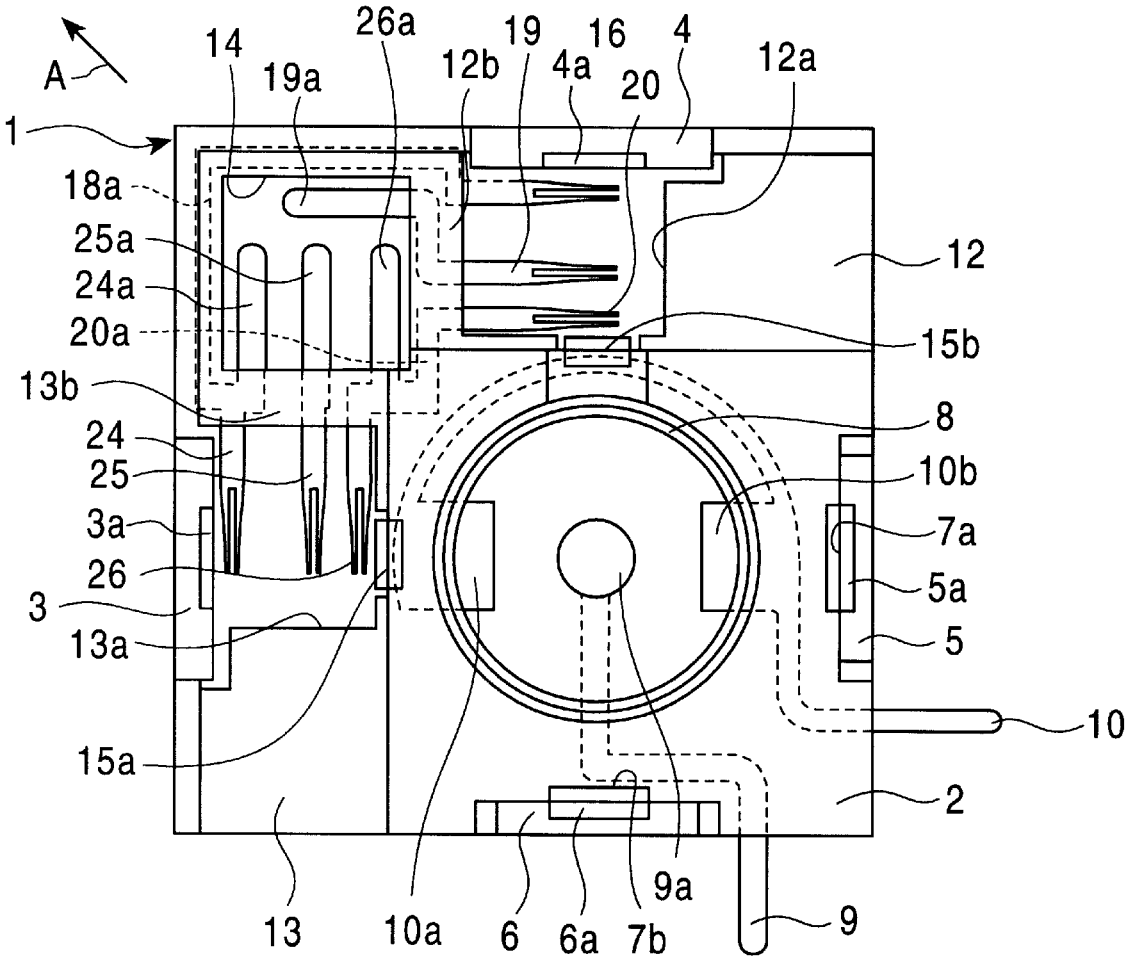
FIG. 5 is a plan view of a case according to the multi-direction input device of the embodiment of the present invention.

The case 1 is molded of an insulating synthetic resin material and includes a square bottom wall section 2, and four standing walls 3, 4, 5, and 6 which are disposed on the four sides of the bottom wall section 2. As shown in FIG. 1 and FIG. 5, taper surfaces 3*a*, 4*a*, 5*a*, and 6*a* are formed on the free end sides of the standing walls 3 to 6 on the inner wall surfaces thereof such that they incline inwardly toward the bottom surface section 2. Locking holes 3*b*, 4*b*, 5*b*, and 6*b* which extend from the lower portions of the taper surfaces 3*a*, 4*a*, 5*a*, and 6*a* to the bottom wall section 2 are formed to these standing walls 3 to 6. Further, through holes 7*a* and 7*b* are formed through the bottom wall section 2 so as to continue to the locking holes 5*b* and 6*b*, respectively and an annular projection 8 is formed on the bottom wall section 2 as well as a pair of terminals 9 and 10 are insert molded and mounted on the bottom wall section 2 with one ends thereof projecting to the outside. The other ends of the pair of terminals 9 and 10 are exposed on the bottom wall section 2 in the annular projection 8 and arranged as a fixed contact 9*a* and contact sections 10*a* and 10*b*. Then, a dome-shaped click spring 11 as a movable contact, which is composed of a conductive thin metal sheet, is accommodated in and held by the annular projection 8 with its flange portion 11*a* in contact with the contact sections 10*a* and 10*b*, whereby a push button is arranged.

Further, a guide groove 12, which extends along a side of the bottom wall section 2 so as to partly cut out the fixed end of the standing wall 4, and a guide groove 13, which extends along an end of the bottom wall section 2 so as to partly cut out the fixed end of the standing wall 3 are formed on the bottom wall section 2, through holes 12*a* and 13*a* are formed through the guide grooves 12 and 13 so as to continue to the locking holes 4*b* and 3*b*, and a square extracting hole 14 is formed at a corner where the guide groove 12 intersects the guide groove 13 while remaining partitioned sections 12*b* and 13*b* between the through holes 12*a* and 13*a*. Then, hook sections 15*a* and 15*b* are formed on the edges on the guide grooves 12 and 13 in confrontation with the standing walls 3 and 4, respectively. (Note that the standing wall 5 in FIG. 1 is shown with its free end side cut out.)

Figure 6:
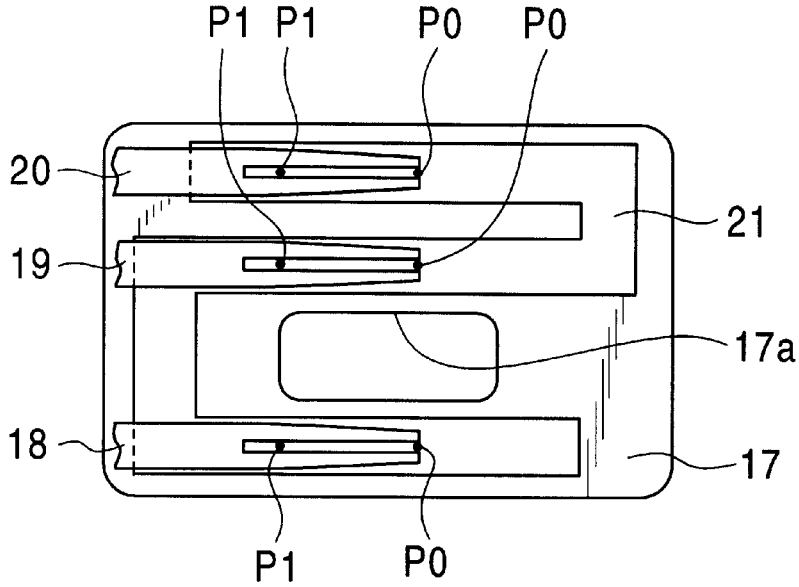
FIG. 6 is a backside view of a movable member according to a first detecting unit provided with the multi-direction input device of the embodiment of the present invention.

The first turn detecting unit 16 is composed of a movable member 17 formed of an insulating synthetic resin and having a rectangular plate shape, three sliders 18 to 20 as fixed side elements formed of a conductive thin sheet, and a resistor layer 21 as a movable side element disposed zigzag on the back surface of the movable member 17. A signal creating section is composed of the three sliders 18 to 20 and the resistor layer 21. As shown in FIG. 5, the three sliders 18 to 20 are mounted on the partitioned section 12*b* by insert molding with the extreme ends thereof projecting into the through hole 12*a*. Then, a terminal 19*a*, which is bent and extracted from the extracting hole 14 downward, is formed on the rear end of the slider 19 integrally therewith as well as the rear ends of the sliders 18 and 20 are extended, respectively and arranged as coupling pieces 18*a* and 20*a*. In addition, as shown in FIG. 2 and FIG. 6, the movable member 17 includes an engaging hole 17*a* formed therethrough, is held by the case 1 with both the sides thereof locked by the hook section 15*b* and by the fixed end of the standing wall 4, and can be reciprocated along the guide groove 12 with the extreme ends of the three sliders 18 to 20 in sliding contact with the resistor layer 21.

Figure 7:
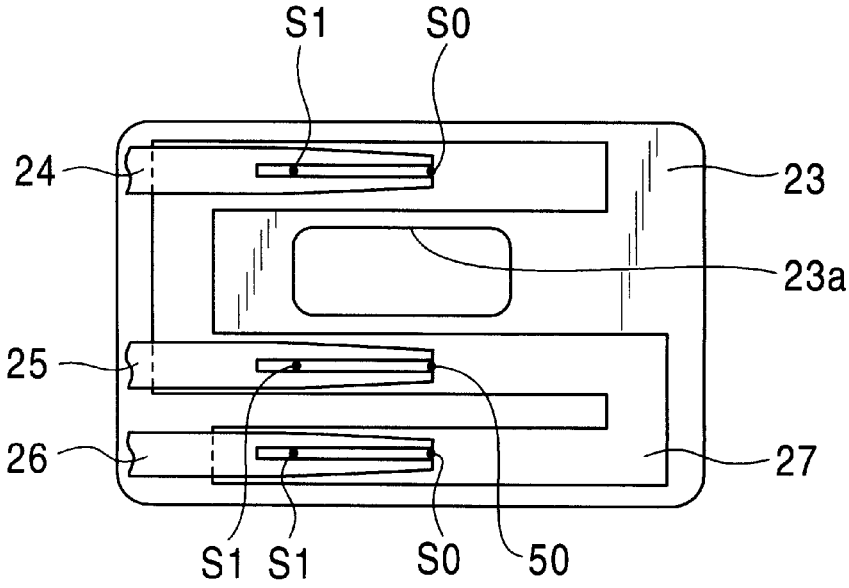
FIG. 7 is a backside view of a movable member according to a second detecting unit provided with the multi-direction input device of the embodiment of the present invention.
Figure 8:
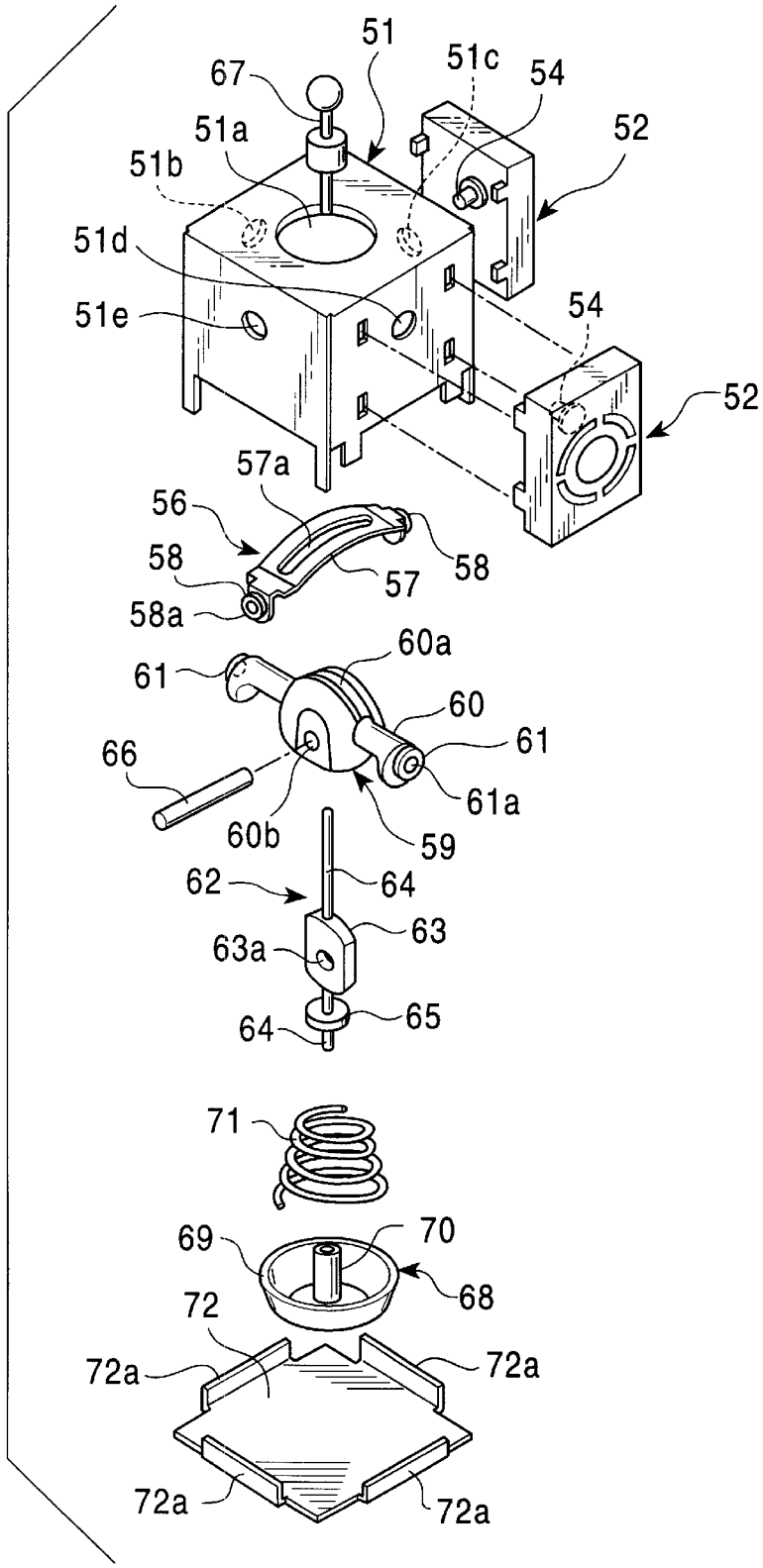
FIG. 8 PRIOR ART
FIG. 8 is an exploded perspective view of a conventional multi-direction input device.
Figure 9:
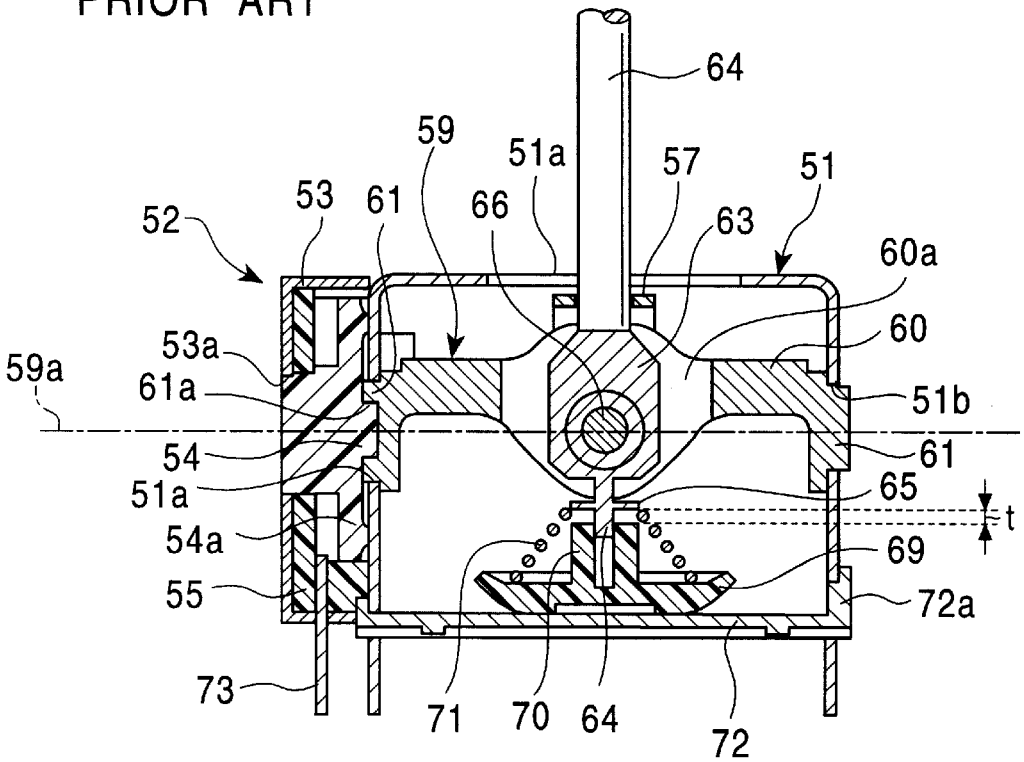
FIG. 9 PRIOR ART
FIG. 9 is a sectional view of the conventional multi-direction input device.
Figure 10:
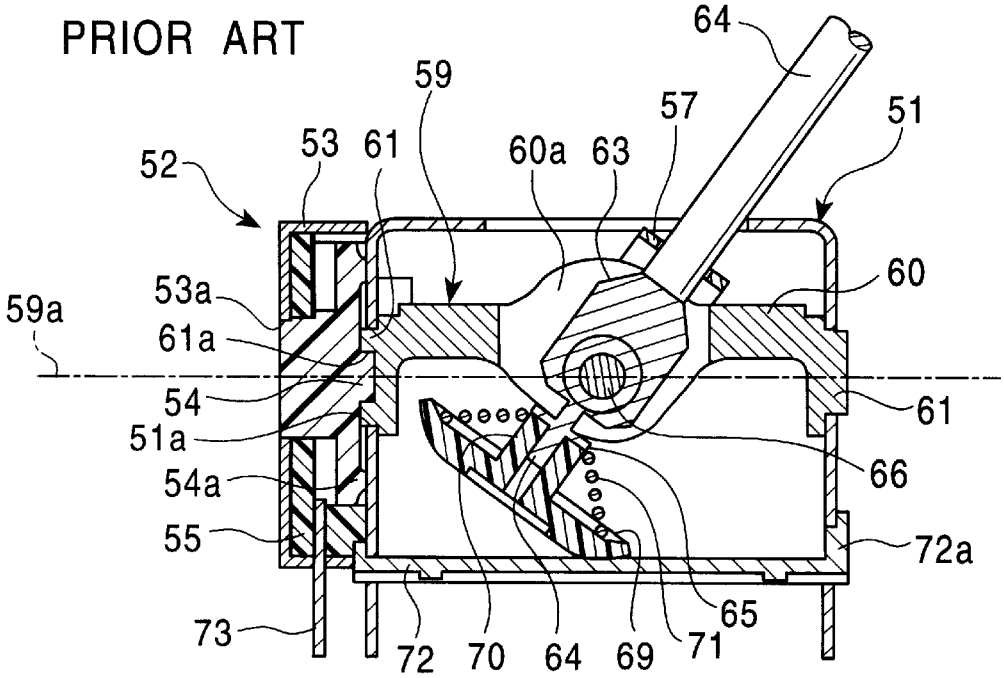
FIG. 10 PRIOR ART
FIG. 10 is a view explaining operation of the conventional multi-direction input device.

The second turn detecting unit 22 is composed of a movable member 23 formed of an insulating synthetic resin and having a rectangular plate sheet shape, three sliders 24 to 26 as fixed side elements formed of a conductive thin sheet, and a resistor layer 27 as a movable side element disposed zigzag on the back surface of the movable member 23. A signal creating section is composed of the three sliders 24 to 26 and the resistor layer 27. As shown in FIG. 5, the three sliders 24 to 26 are mounted on the partitioned section 13*b* by insert molding with the extreme ends thereof projecting into the through hole 13*a*. Then, terminals 24*a* to 26*a*, which are bent and extracted from the extracting hole 14 downward, are formed on the rear ends of the sliders 24 to 26 integrally therewith as well as the coupling pieces 18*a* and 20*a*, which are extended from the above-described sliders 18 to 20, are formed on the rear ends of the sliders 24 and 26 integrally therewith, respectively. In addition, as shown in FIG. 1 and FIG. 7, the movable member 23 includes an engaging hole 23*a* and is held by the case 1 with both the sides thereof locked by the hook section 15*a* and by the fixed end of the standing wall 3 and can be reciprocated along the guide groove 13 with the extreme ends of the three sliders 24 to 26 in sliding contact with the resistor layer 27.

Note that the sliders 18 to 20, the sliders 24 to 26, the coupling pieces 18*a* and 20*a*, the terminal 19*a*, the terminals 24*a* to 26*a*, and the pair of terminals 9 and 10 are formed by stamping on a common conductive thin sheet and wound in a hoop state integrally and cut off at predetermined positions after they are insert molded on the case 1, and then they are formed in the above-described shapes.

Figure 2:
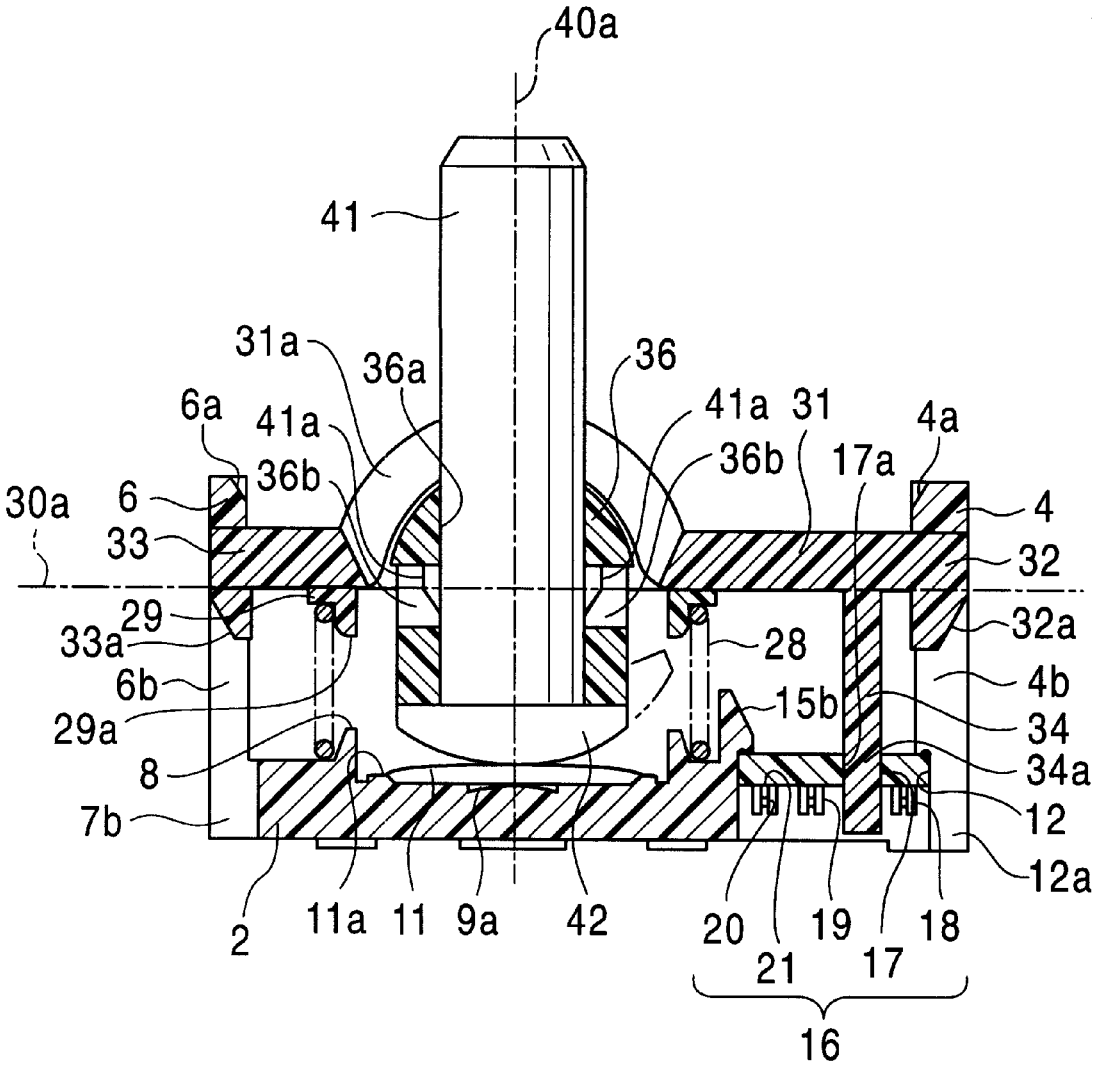
FIG. 2 is a sectional view taken along the line 2—2 of FIG. 1.
Figure 3:
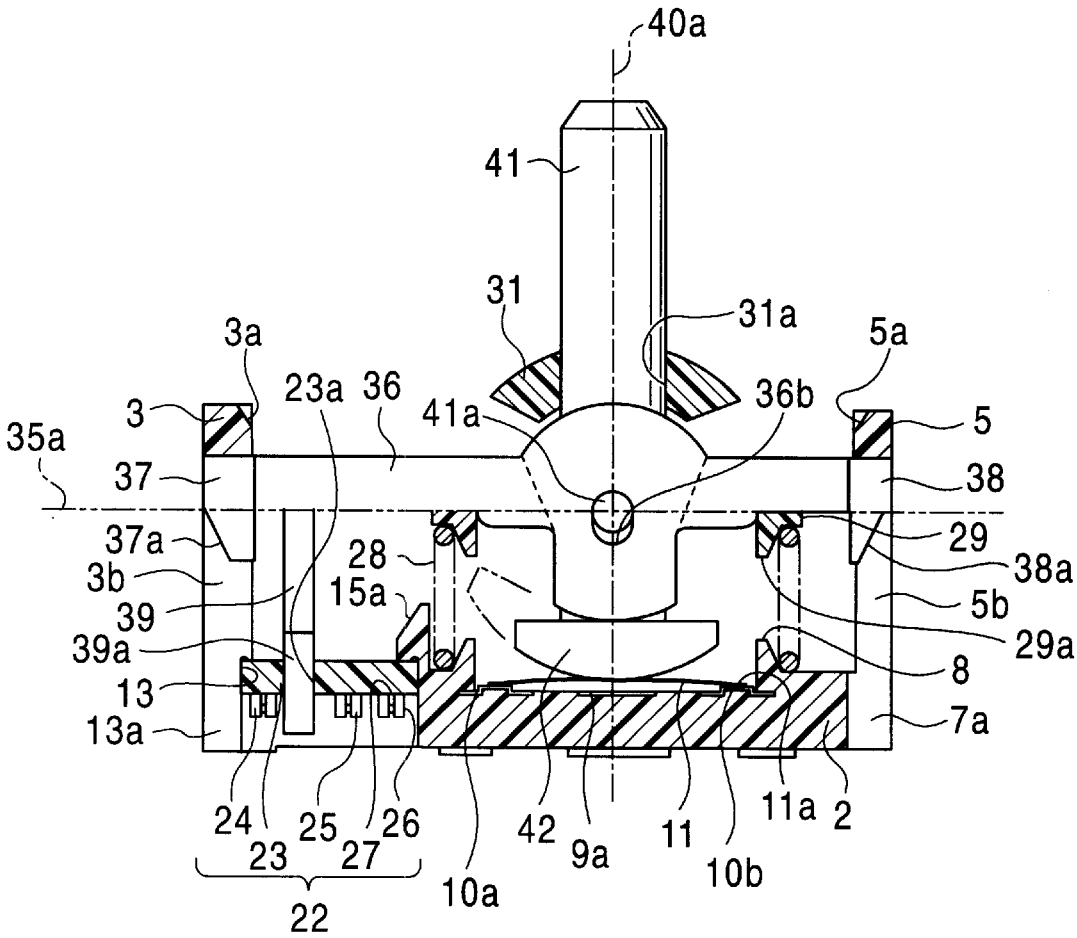
FIG. 3 is a sectional view taken along the line 3—3 of FIG. 1.

The return spring 28 is composed of a cylindrical coil spring and mounted on the case 1 with an annular projection engaged with the lower end thereof, as shown in FIG. 2.

Further, a ring-shaped spring receiver 29 is supported on the upper end of the return spring 28 with the annular wall section 29*a* formed along the inner peripheral edge thereof engaged with the return spring 28.

The first association member 30 is molded of an insulating synthetic resin material and includes a semi-columnar base section 31 whose central portion is swelled upward and mounting sections 32 and 33 disposed on both the ends of the base section 31. A hole 31*a*, which extends in the lengthwise direction of the base section 31, is formed through the swelled portion of the base section 31, and taper surfaces 32*a* and 33*a*, which correspond to the taper surfaces 4*a* and 6*a* of the standing walls 4 and 6, respectively, are formed on the mounting sections 32 and 33. Further, an arm-shaped first actuating section 34 is suspended from the lower surface of the base section 31 integrally therewith at a position, which is located between the mounting section 32 and the hole 31*a* and spaced apart from the mounting section 32, in a suspended condition. A round-shaped portion 34*a* is formed at the extreme end of the first actuating section 34. Then, the first association member 30 is turnably suspended by the standing walls 4 and 6, which are in confrontation with each other, and supported by the case 1 with the lower surface of the base section 31 abutted against the spring receiver 29 and with both the mounting sections 32 and 33 locked to the upper ends of the locking holes 4*b* and 6*b*. Further, the round-shaped portion 34*a* is inserted into and engaged with engaging hole 17*a* of the movable member 17 of the first turn detecting unit 16.

The second association member 35 is molded of an insulating synthetic resin material and includes a semi-columnar base section 36 whose central portion is swelled upward and mounting sections 37 and 38 disposed on both the ends of the base section 36. A hole 36*a*, which extends in the lengthwise direction of the base section 36, and a running-track-shaped inserting hole 36*b*, which intersects the hole 36*a*, are formed through the swelled portion of the base section 36, respectively, and taper surfaces 37*a* and 38*a*, which correspond to the taper surfaces 3*a* and 5*a* of the standing walls 3 and 5, respectively, are formed on the mounting sections 37 and 38. Further, an arm-shaped second actuating section 39 is suspended from the lower surface of the base section 36 integrally therewith at a position, which is located between the mounting section 37 and the hole 36*a* and spaced apart from the mounting section 37, in a suspended condition. A round-shaped portion 39*a* is formed at the extreme end of the second actuating section 39. Then, the second association member 35 is supported by the case 1 in a state in which it overlaps the first association member 30 in an intersecting state in such a manner that the lower surface of the base section 36 is abutted against the spring receiver 29, both the mounting sections 37 and 38 are locked to the upper ends of the locking holes 3*b* and 5*b*, and the second association member 35 is turnably suspended by the standing walls 3 and 5, which are in confrontation with each other. The holes 31*a* and 36*a* confront each other at the portion where the first association member 30 overlaps the second association member 35, and the round-shaped portion 39*a* is inserted into and engaged with engaging hole 23*a* of the movable member 23 of the second turn detecting unit 22.

The lever member 40 is molded of an insulating synthetic resin material and includes a columnar shaft section 41 and a presser section 42, which is disposed at the lower end of the columnar shaft section 41 and formed integrally therewith, and a pair of projections 41*a* are formed on outer wall surfaces of the shaft section 41. Then, the lever member 40 is inclinably supported by the case 1 through the second association member 35 in such a manner that the shaft section 41 is inserted into the holes 31*a* and 36*a* of the first and second association members 30 and 35 and the pair of projections 41*a* are locked in the inserting hole 36*b* of the second association member 35 so as to be snapped therein. In the above arrangement, the presser section 42 is located in the annular projection 8 of the case 1 and abutted against the click spring 11, and the pair of projections 41*a* are located at the upper end of the inserting hole 36*b*.

Next, a method of assembling the multi-direction input device arranged as described above will be described. First, the sliders 18 to 20 are confronted with the resistor layer 21, and the movable member 17 is inserted between the hook section 15*b* and the standing wall 4 and held by the case 1. Then, the sliders 24 to 26 are confronted with the resistor layer 27, and the movable member 23 is inserted between the hook section 15*a* and the standing wall 3 and held by the case 1. Next, the return spring 28 is attached to the case 1 in such a manner that the click spring 11 is accommodated in and held by the annular projection 8 of the case 1, then the annular wall section 29*a* is engaged with the upper end of the return spring 28, and the lower end of the return spring 28, which is supported by the spring receiver 29, is engaged with the annular projection 8.

Thereafter, the lever member 40 is assembled with the second association member 35 and they are arranged as a unit by inserting the lever member 40 into the hole 36*a* of the second association member 35 from the upper end thereof and locking the pair of projections 41*a* in the engaging hole 36*b* so that they are snapped therein. When the unit is inserted between the standing walls 3 and 5 from the free end sides thereof while corresponding the taper surfaces 37*a* and 38*a* of the second association member 35 to the taper surfaces 3*a* and 5*a* of the standing walls 3 and 5, the unit can be inserted therebetween while flexing the standing walls 3 and 5 externally, with the taper surfaces 37*a* and 38*a* of the second association member 35 guided by the taper surfaces 3*a* and 5*a*. When the mounting sections 37 and 38 pass through the inner wall surface under the taper surface 3*a* of the standing wall 3 and the inner wall surface under the taper surface 5*a* of the standing wall 5, respectively, the standing walls 3 and 5 return to their original states, and the mounting sections 37 and 38 are inserted into and locked in the respective locking holes 3*b* and 5*b* of the standing walls 3 and 5, which have elastically returned inwardly, and snapped therein. Accordingly, the unit is turnably suspended by the standing walls 3 and 5.

Next, when the hole 31*a* of the first association member 30 is fit on the shaft section 41 from the upper end of the lever member 40 and the first association member 30 is inserted between the standing walls 4 and 6 from the free end sides thereof while corresponding the taper surfaces 32*a* and 33*a* of the first association member 30 to the taper surfaces 4*a* and 6*a* of the standing walls 4 and 6, the first association member 30 can be inserted therebetween while flexing the standing walls 4 and 6 externally with the taper surfaces 32*a* and 33*a* thereof being guided by the taper surfaces 4*a* and 6*a* of the standing walls 4 and 6. When the mounting sections 32 and 33 pass through the inner wall surface under the taper surface 4*a* of the standing wall 4 and the inner wall surface under the taper surface 6*a* of the standing wall 6, respectively, the standing walls 4 and 6 return to their original states, the mounting sections 32 and 33 are inserted into and locked in the respective locking holes 4*b* and 6*b* of the standing walls 4 and 6, which have elastically been returned inwardly and snapped therein.

Thus, the first association member 30 overlaps the second association member 35 in an intersecting state and turnably suspended by the standing walls 4 and 6.

The assembly of the multi-direction input device is finished as described above. After it is assembled, the spring receiver 29 is abutted against the lower surfaces of the base sections 31 and 36 of the first association members 30 and 35. The mounting sections 32, 33, 37, and 38 are located on the upper ends of the respective locking holes 3*b*, 4*b*, 5*b*, and 6*b*. The lever member 40 is located at an initial position where its axial line 40*a* is orthogonal to the bottom wall section 2 of the case 1 and the presser section 42 is abutted against the click spring 11, and the movable members 17 and 23 are located in the respective guide grooves 12 and 13. The round-shaped portions 34*a* and 39*a* of the first and second actuating sections 34 and 39 are inserted into and locked in the engaging holes 17*a* and 23*a* of the respective movable members 17 and 23. The three sliders 18 to 20 come into contact with the resistor layer 21. The terminal 24*a* is electrically connected to the terminal 26*a* through the coupling piece 18*a*, the slider 18, the resistor layer 21, the slider 20, and the coupling piece 20*a*. Further, the three sliders 24 to 26 come into contact with the resistor layer 27, and the terminal 24*a* is electrically connected to the terminal 26*a* through the slider 24, the resistor layer 27 and the slider 26.

Figure 4:
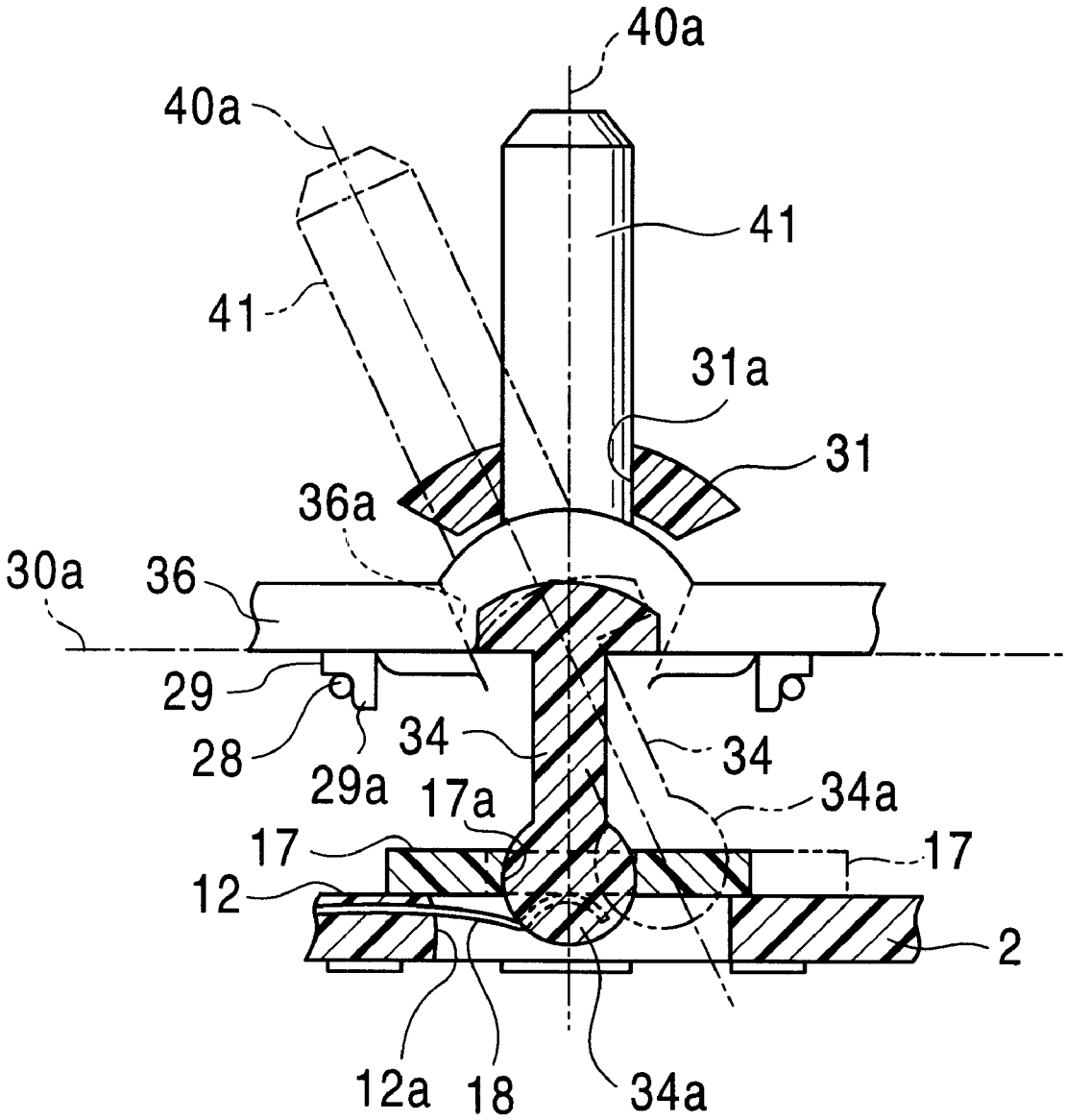
FIG. 4 is a view explaining operation of the multi-direction input device of the embodiment of the present invention.

The multi-direction input device arranged and assembled as described above is used in a state in which a predetermined voltage is imposed between the terminals 24*a* and 26*a* and between the terminals 9 and 10. When an operator inclines the shaft section 41 of the lever member 40 in a direction of, for example, an arrow A shown in FIG. 5, the first and second association members 30 and 35 are turned while the shaft section 41 is loosely moved in the holes 31*a* and 36. Thus, the spring receiver 29 is pressed against the lower surfaces of the base sections 31 and 36 of the first and second association members 30 and 35, whereby the first actuating section 34 is turned together with the base section 31 of the first association member 30 and the second actuating section 39 is turned together with the base section 36 of the second association member 35 while compressing the return spring 28. Then, as shown in FIG. 4, when the shaft section 41 of the lever member 40 is inclined from the initial position shown by a solid line to a state shown by a dotted line, the first actuating section 34 is turned from an initial position shown by a solid line to a state shown by a dotted line. The turning motion of the first actuating section 34 causes the movable member 17, which is engaged with the round-shaped portion 34*a*, to move from an initial position shown by a solid line to a position shown by a dotted line along the guide groove 12 with the resistor layer 21 in sliding contact with the three sliders 18 to 20.

As the first actuating section 34 is moved, the positions, where the resistor layer 21 is in sliding contact with the extreme ends of the three sliders 18 to 20, are moved from initial positions P0 to positions P1 as shown in FIG. 6. As a result, a resistance value (voltage value) between the sliders 18 and 19 is changed, and the first turn detecting unit 16 detects the turn of the first actuating section 34. The signal creating section, which composed of the three sliders 18 to 20 and the resistor layer 21, creates a detecting signal (voltage signal) corresponding to a change of the resistance value, and the detecting signal is fetched from the terminal 19*a* through the slider 19.

In the same way, the turn of the second actuating section 39 resulting from the inclination of the lever member 40 causes the movable member 23, which is engaged with the round-shaped portion 39*a*, to be moved along the guide groove 13 with the resistor layer 27 in sliding contact with the three sliders 24 to 26, whereby the positions, where the resistor layer 27 is in sliding contact with the extreme ends of the three sliders 24 to 26, are changed from initial positions S0 to positions S1. As a result, a resistance value (voltage value) between the sliders 24 and 25 is changed, and the second turn detecting unit 22 detects the turn of the second actuating section 39. The signal creating section, which is composed of the three sliders 24 to 26 and the resistor layer 27, creates a detecting signal (voltage signal) corresponding to a change of the resistance value, and the detecting signal is fetched from the terminal 25*a* through the slider 25. Then, the detecting signals fetched from the terminals 19*a* and 25*a* correspond to an amount of inclination of the lever member 40, are supplied to, for example, a display device (not shown) and a position of a cursor on a display (the illustration of which is omitted) is controlled. Therefore, the cursor on the display unit can be moved in any optional direction by inclining the lever member 40.

Further, when a force for inclining the lever member 40 is removed, the spring receiver 29 is pushed upward and returned by the restoring force of the return spring 28 so that the first and second association members 30 and 35 are turned. As a result, the lever member 40 is raised while loosely moving in the holes 31*a* and 36*a* and returned to the initial position as well as the first and second actuating sections 34 and 39 are turned in a direction opposite to the above direction together with the respective movable members 17 and 23 and returned to the initial position.

In contrast, when the operator presses the shaft section 41 of the lever member 40 downward, the pair of projections 41*a* are slid in the direction of the axial line 40*a* while being guided by the inserting hole 36*b*, whereby the lever member 40 is lowered and the click spring 11 is pressed by the presser section 42 so that the click spring 11 is reversed and comes into contact with the fixed contact 9*a*. With this operation, a feeling of click is made, and the fixed contact 9*a* is electrically connected to the contact sections 10*a* and 10*b* by the click spring 11 so that the above push button is turned on, and a switch-turn-on signal is output from the terminal 9 or 10.

Further, when a force for pressing lever member 40 is removed in this state, since the click spring 11 returns to its original dome shape by the reversing and restoring force thereof, the presser section 42 is pressed upward by the click spring 11 and the lever member 40 is returned to the initial position. Accordingly, the click spring 11 is spaced apart from the fixed contact 9*a* and the electric connections between the fixed contact 9*a* and the contact sections 10*a* and 10*b* are released, from which a switch-turn-off state results. Therefore, a coordinate can be input or a menu can be selected by pressing the lever member 40 after the above cursor is moved up to a desired coordinate position or to a desired menu position by inclining the lever member 40.

As described above, in the multi-direction input device, the first actuating section 34 is projected in a direction, which intersects a straight line 30*a* connecting the centers of turn of both the mounting sections 32 and 33 of the first association member 30, the second actuating section 39 is projected in a direction, which intersects a straight line 35*a* connecting the centers of turn of both the mounting sections 37 and 38 of the second association member 39, the first and second turn detecting units 16 and 22, which correspond to the rotary type variable resistors 52 of the conventional art, are disposed in a region surrounded by the four standing walls 3 to 6 in the interior thereof, and the turning motions of the first and second actuating sections 34 and 39 are detected by the first and second turn detecting units 16 and 22. As a result, the size of the multi-direction input device can be reduced in the direction in which the straight line 30*a* extends and in the direction in which the straight line 35*a* extends and the device can be miniaturized thereby.

Further, in the multi-direction input device, the first association member 30 is turnably suspended by the pair of confronting standing walls 4 and 6 and supported by the case 1 and the second association member 35 is turnably suspended the pair of confronting standing walls 3 and 5 and supported by the case 1 in such a manner that the mounting sections 32, 33, 37, and 38 are locked in the locking holes 3*b* to 6*b* of the four standing walls 3 to 6 and snapped therein. As a result, the adjustment job described in the conventional art is not necessary, the multi-direction input device can simply be assembled, and the first and second association members 30 and 35 can smoothly be turned without the need of any adjustment. Furthermore, in the conventional art, while the two components, that is, the frame member 51, in which the rotary type variable resistors 52 are mounted, and the lid plate 72, to which an elastic force of the return spring 71 is applied, is necessary, these components can be replaced by the case 1 as a single component in the multi-direction input device, which permits the reduction of the number of components, in addition to the above adjustment free arrangement.

While it has been described in the embodiment that the movable members 17 and 23, which are formed in the rectangular plate shape are slid linearly along the respective guide grooves 12 and 13, the present invention is not limited thereto. That is, the sliders 19 and 20 may be in sliding contact with the resistor layer 21 and the sliders 24 to 26 may be in sliding contact with the resistor layer 27 in such a manner that the movable members 17 and 23 are formed in a semi-circular flat plate shape, turnably supported on the bottom wall section 2 of the case 1 through the centers of circles thereof and turned by the first and second actuating sections 34 and 39. Further, the signal creating sections of the first and second turn detecting units 16 and 22 may be composed of a combination of a plurality of conductive sections such as pulse encoders and sliding pieces which are in contact with and separated from them, a combination of magnets and Hall elements, and the like.

The present invention is embodied as described above and will achieve the following advantages.

The multi-direction input device of the present invention includes the case, which has the bottom wall section and the four standing walls disposed on the four sides thereof, the first and second association members, which overlap each other in the intersecting state and supported by the case and have the holes formed therethrough at the positions thereof where they overlap each other, and the lever member, which is inclinably supported by the case and inserted into the respective holes of the first and second association members. In the above arrangement, the locking holes are formed through the four standing walls, respectively, the first and second association members are inserted from the free end sides of the four standing walls while flexing them externally, and both the ends of the first and second association members are locked in the respective locking holes of the four standing walls, which have elastically returned inwardly and snapped therein, whereby the first and second association members are turnably suspended by the respective confronting pairs of standing walls. As a result, the adjustment job described in the conventional art is not necessary and the multi-direction input device can be simply assembled, whereby the first and second association members can easily be suspended and can smoothly be turned without the need of any adjustment.

The taper surfaces are formed on the free end sides of the four standing walls on the inner wall surfaces thereof such that they incline inwardly toward the bottom wall section from the extreme ends of the free end sides, and both the ends of the first and second association members are inserted into and locked in the respective locking holes of the four standing walls by being guided by the taper surfaces. As a result, both the ends of the first and second association members can easily be locked in the respective locking holes of the four standing walls and snapped therein.

Since the lever member, which has been inserted into the hole of the second association member, is locked and snapped therein so as to be mounted on the second association member, the lever member can simply be supported by the case through the second association member. The first actuating section, which projects in the direction intersecting the straight line connecting the centers of turn of the mounting sections disposed at both the ends of the first association member, is formed on the first association member, the second actuating section, which projects in the direction intersecting the straight line connecting the centers of turn of the mounting sections disposed at both the ends of the second association member, is disposed on the second association member, the inclination of the lever member causes the first actuating section to turn together with the first association member and the second actuating section to turn together with the second association member, and the case is provided with the first turn detecting unit for detecting the turn of the first arm and the second turn detecting unit for detecting the turn of the second arm. Accordingly, the first and second turn detecting units can be disposed in the direction which intersects the straight line connecting the centers of turn of both the mounting sections of the first association member and in the direction which intersects the straight line connecting the centers of turn of both the mounting sections of the second association member, respectively, whereby the size of the multi-direction input device can be reduced in the direction where the straight line connecting the centers of turn of both the mounting sections of the first association member extends and in the direction where the straight line connecting the centers of turn of both the mounting sections of the second association member extends.

Further, each of the first and second turn detecting units includes the movable member disposed on the case so as to reciprocate, the fixed side elements fixed to the case, and the movable side element disposed on the movable member and forming the signal creating section together with the fixed side elements, the movable member of the first turn detecting unit and the movable member of the second turn detecting unit are engaged with the first and second arm sections and moved as the first and second arm sections are turned, whereby the signal creating sections of the first and second turn detecting units create detecting signals. As a result, the turns of the first and second actuating sections can reliably be detected in spite of that the above components are arranged simply.

What is claimed is:

1. A multi-direction input device, comprising:

first and second association members overlapping each other in an intersecting state, said first and second association members each including a base section which has a hole formed therethrough at a position thereof where the hole of the first association member and the hole of the second association member overlap each other, and mounting sections disposed at both ends of the base section;

a case to support the mounting sections of said first and second association members so as to turnably suspend the first and second association members, said case having generally parallel first and second walls spaced apart by a predetermined clearance, and generally parallel third and fourth walls spaced apart by a predetermined clearance, said third and fourth walls each being disposed at right angles to said first and second walls, said first to fourth walls being provided with first to fourth holes, respectively, said first association member being rotatably supported by said case by the insertion of the mounting sections thereof in said first and second holes, said second association member being rotatably supported by said case by the insertion of the mounting sections thereof in said third and fourth holes; and a operating shaft supported by said case and inserted into the respective holes of said first and second association members, said operating shaft being rotatably held by said second association member so as to be inclinable relative to said case, wherein a first actuating section, which projects in a direction intersecting a straight line connecting centers of turn of both the mounting sections of said first association member is formed on the base section thereof, and a second actuating section, which projects in a direction intersecting a straight line connecting the centers of turn of both the mounting sections of said second association member, is disposed on the base section thereof, wherein an inclination of said operating shaft in a first direction causes said first actuating section to turn together with said first association member, and an inclination of said operating shaft in a second direction causes said second actuating section to turn together with said second association member, and wherein said case is provided with a first turn detector to detect a turn of said first actuating section and with a second turn detector to detect a turn of said second actuating section.

2. A multi-direction input device according to claim 1, wherein each of said first and second turn detectors includes a movable member disposed on said case to reciprocate thereon, fixed side elements fixed on said case, and a movable side element disposed on said movable member and forming a signal creating section together with said fixed side elements, said movable member of said first turn detector and said movable member of said second turn detector are engaged with said first and second actuating sections, respectively and moved as said first and second actuating sections are turned, whereby said signal creating sections of said first and second turn detectors create detecting signals.

3. A multi-direction input device according to claim 2, wherein said movable side element comprises a resistor layer formed on said movable member and said fixed side elements comprise sliders which are in sliding contact with said resistor layer as well as terminals to output the detecting signal are formed integrally with said sliders.

4. A multi-direction input device according to claim 3, wherein said first and second turn detectors are disposed in a region surrounded by said first to fourth walls.

5. A multi-direction input device according to claim 4, wherein a round-shaped portion is formed at an extreme end of each of said first and second actuating sections, and a slot, into which the round-shaped portion is inserted, is formed through each of said movable members.

6. A multi-direction input device, comprising:

a case including a bottom wall section and four standing walls disposed on four sides thereof;

first and second association members overlapping each other in an intersecting state and supported by said case, said first and second association members each having an operating hole formed therethrough at a position where the operating hole of the first association member and the operating hole of the second association member overlap with each other; and a operating shaft inclinably supported by said case and inserted into the respective operating holes of said first and second association members, wherein a locking hole is formed through each of said four standing walls, respectively, wherein said first association member is inserted into and passed through the locking holes of a first pair of oppositely facing standing walls while flexing the first pair of standing walls externally, and said second association member is inserted into and passed through the locking holes of a second pair of oppositely facing standing walls while flexing the second pair of standing walls externally, said first and second association members each having ends that are locked in the respective locking holes of said four standing walls, said standing walls being elastically returned inwardly after the insertion of said first and second association members therein, whereby said first and second association members are turnably suspended by the respective confronting pairs of standing walls, and wherein said operating shaft is rotatably held by said second association member.

7. A multi-direction input device according to claim 6, wherein a tapered surface is formed on a free end side of each of said four standing walls on an inner wall surface thereof such that the tapered surfaces incline inwardly toward said bottom wall section from extreme ends of the free end sides, and both ends of said first and second association members are inserted into and locked in the respective locking holes of said four standing walls by being guided by the tapered surfaces.

8. A multi-direction input device according to claim 6, wherein said operating shaft, which has been inserted into the operating hole of said second association member, is locked and snapped therein so as to be mounted on said second association member.

9. A multi-direction input device according to claim 6, wherein a first actuating section, which projects in a direction intersecting a straight line connecting centers of turn of mounting sections disposed at both ends of said first association member, is formed on said first association member, and a second actuating section, which projects in a direction intersecting a straight line connecting centers of turn of mounting sections disposed at both ends of said second association member, is disposed on said second association member, and wherein an inclination of said operating shaft causes said first actuating section to turn together with said first association member and said second actuating section to turn together with said second association member, said case being provided with a first turn detector to detect a turn of said first actuating section and a second turn detector to detect a turn of said second actuating section.

10. A multi-direction input device according to claim 9, wherein each of said first and second turn detectors includes a movable member disposed on said case to reciprocate, fixed side elements fixed to said case, and a movable side element disposed on said movable member and forming a signal creating section together with said fixed side elements, said movable member of said first turn detector and said movable member of said second turn detector being engaged with said first and second actuating sections and moved as said first and second actuating sections are turned, whereby said signal creating sections of said first and second turn detectors create detecting signals.

* * * * *